US011795927B2

(12) United States Patent
Ottestad

(10) Patent No.: US 11,795,927 B2
(45) Date of Patent: Oct. 24, 2023

(54) PUMP DEVICE

(71) Applicant: OBS Technology AS, Husøysund (NO)

(72) Inventor: Nils Terje Ottestad, Tønsberg (NO)

(73) Assignee: OBS Technology AS, Husøysund (NO)

( * ) Notice: Subject to any disclaimer, the term of this patent is extended or adjusted under 35 U.S.C. 154(b) by 192 days.

(21) Appl. No.: 17/602,085

(22) PCT Filed: Apr. 9, 2019

(86) PCT No.: PCT/EP2019/058917
§ 371 (c)(1),
(2) Date: Oct. 7, 2021

(87) PCT Pub. No.: WO2020/207561
PCT Pub. Date: Oct. 15, 2020

(65) Prior Publication Data

US 2022/0178357 A1 Jun. 9, 2022

(51) Int. Cl.
*F04B 9/109* (2006.01)
*F04B 5/02* (2006.01)
*F04B 9/105* (2006.01)

(52) U.S. Cl.
CPC ..... *F04B 5/02* (2013.01); *F04B 9/109* (2013.01); *F04B 9/1053* (2013.01)

(58) Field of Classification Search
CPC ..... F04B 9/105; F04B 9/1053; F04B 9/113; F04B 9/1172
See application file for complete search history.

(56) References Cited

U.S. PATENT DOCUMENTS 4,548,551 A 10/1985 Ruttenberg et al.
4,653,986 A 3/1987 Ashton
6,357,235 B1 3/2002 Cerro
6,435,843 B1 8/2002 Hur
(Continued)

FOREIGN PATENT DOCUMENTS

GB 1450538 A 9/1976
NO 20151414 A1 * 4/2017
(Continued)

OTHER PUBLICATIONS

International Search Report issued in International Application No. PCT/EP2019/058917, dated Jun. 18, 2019 (4 pages).
(Continued)

*Primary Examiner* — Thomas Fink
(74) *Attorney, Agent, or Firm* — Osha Bergman Watanabe & Burton LLP

(57) ABSTRACT

A double-acting pump device includes a piston arrangement being slidably arranged in a pump housing. The pump housing is separated into a drive section with a drive fluid inlet and a drive fluid outlet and a pump section with an inlet and an outlet for a pump fluid. The drive section includes a switch mechanism which utilizes the difference between the drive fluid supply pressure and the drive fluid outlet pressure to reciprocate the piston arrangement, such that axially acting forces are transferred to the pump fluid which thereby achieves a desired pressure increase. Thus, the double-acting pump is arranged to utilize the energy in a supplied drive fluid to provide a defined pressure increase in a supplied pump fluid.

4 Claims, 6 Drawing Sheets

(56) References Cited

U.S. PATENT DOCUMENTS

| | | | | |
|---|---|---|---|---|
| 2010/0166573 | A1* | 7/2010 | Magami | F04B 9/113 417/267 |
| 2012/0063939 | A1 | 3/2012 | Mann | |

FOREIGN PATENT DOCUMENTS

| | | | | |
|---|---|---|---|---|
| NO | 340558 | B1 | 5/2017 | |
| NO | 20161801 | A1 | 5/2018 | |
| WO | 8802818 | A1 | 4/1988 | |
| WO | 9420754 | A1 | 9/1994 | |
| WO | WO-0216766 | A2 * | 2/2002 | F03C 1/0076 |

OTHER PUBLICATIONS

Written Opinion issued in International Application No. PCT/EP2019/058917; dated Jun. 18, 2019 (6 pages).

* cited by examiner

PUMP DEVICE

TECHNICAL FIELD OF THE INVENTION

The present invention is related to the field of pump devices and more particularly to the field of reciprocating pumps.

BACKGROUND

Norwegian patent 340558 concerns a pump device arranged to pump liquid from approximately pressureless tanks arranged subsea. The pressure device has several features in common with the present invention and is considered to represent the closest prior art. However, the pump device may not be configured to create a desired depth-independent relationship between the drive/forward pressure (=the overpressure of the drive fluid in relationship to the ambient pressure) and the pressure increase of a supplied pump fluid. This latter entails that the prior art pump device is not suitable for use as:

1. a pressure booster pump—e.g. using the overpressure of a drive fluid in relationship to the ambient pressure to provide a desired pressure increase of a pump fluid which initially has a pressure approximately equal to the ambient pressure.
2. an intensifier—e.g. using the overpressure of a drive fluid in relationship to the ambient pressure to increase the pressure of a part of the drive fluid, or optionally to increase the pressure of a pump fluid having the same pressure as the drive fluid.
3. a low-pressure pump—e.g. using the overpressure of a drive fluid, in relationship to the ambient pressure, to remove liquid from tanks which are approximately pressureless. The liquid is preferably provided to a reservoir which is pressure equalized to ambient or provided directly to the surroundings.

The goal of the present invention is to provide a pump device suitable for use in the above-mentioned operations.

SUMMARY OF THE INVENTION

The present invention is defined by the attached claims and in the following:

In a first aspect the present invention provides a double-acting pump device comprising a piston arrangement being slidably arranged in a pump housing, the pump housing being separated into a drive section with an inlet and an outlet for a drive fluid and a pump section with inlet and an outlet for a pump fluid, and wherein the drive section comprises a switch mechanism which utilizes the difference between the drive fluid supply pressure and the drive fluid outlet pressure to reciprocate the piston arrangement, such that axially acting forces are transferred to the pump fluid which thereby achieves a desired pressure increase, wherein the piston arrangement comprises a drive piston being displaceable in a cylindrical guide in the drive section and having a piston rod being slidably arranged through a partition wall in a fluid-tight manner between the drive section and the pump section, such that the drive section is separated into two drive chambers having different cross-sections, and wherein the drive chamber with the smallest cross-section is permanently open towards the drive fluid inlet, the switch mechanism comprises a switch valve and an initiating valve cooperating with the drive piston via an actuating lever which is subjected to an alternating pull and push each time the drive piston approaches an end point, whereby the initiating valve switches between pressurizing and exhausting a chamber in the switch valve and thereby provide a switch between a first operating condition, wherein the drive chamber having the largest cross-section has an open connection with the inlet and is closed from the outlet, and a second operating condition, wherein the drive chamber is closed off from the inlet and has an open connection with the outlet, the piston arrangement further comprises a displaceable first element being connected to the piston rod on the inside of the pump section and displaceable in relation to a rigidly mounted second element, and the first element cooperates with to sliding seals such that a first, a second and a third chamber in the pump section are separated by fluid-tight barriers, wherein the first chamber is connected with the pump fluid inlet via at least one directional valve being closed when the first chamber is compressed, and which opens for supply of liquid from the inlet when the first chamber is expanded, the second chamber has a smaller cross-section than the first chamber and is compressed and expanded in counter-phase with the first chamber, the second chamber is connected to the first chamber via at least one directional valve which opens when the first chamber is compressed, whereby a part of the liquid provided from chamber is taken up into the second chamber and the remaining part of the liquid is let out via a pump fluid outlet, and which closes when the first chamber is expanded whereby the liquid in the second chamber is let out via the pump fluid outlet, the third chamber is a pressure compensation chamber having an open connection with the drive fluid outlet or with the pump fluid inlet depending on the function which the pump device is configured for.

The piston rod of the drive piston may be defined as being wide, i.e. having a relatively large dimension. The diameter of the piston rod relative the diameter of the drive piston may be within a range ensuring that the two drive chambers will have different cross-sections, wherein the drive chamber with the smallest cross-section is permanently open towards the drive fluid inlet.

In an embodiment, the double-acting pump device comprises a cooperating stabilizing unit, the stabilizing unit comprising a housing having a slidably arranged piston being acted upon in axial direction by the tension of a spring, and the piston separates the housing into three chambers, wherein a first chamber is in permanent and open connection with the drive fluid supply line, a second chamber is in an open connection with the drive fluid outlet and a third chamber has an open connection with the pump fluid outlet, wherein the piston and the spring are dimensioned such that an equilibrium between the forces acting on the piston in an axial direction is obtained during operation, and such that the equilibrium is maintained by having the piston displaceable such that liquid is taken up into or let out from the chambers.

In yet an embodiment, the double-acting pump device is dimensioned such that the first chamber in the pump section has a change in volume being twice as large as the change in volume of the second chamber in the pump section when the piston arrangement is displaced The term «drive fluid» is meant to define a fluid used to run/operate a pump device. The term «pump fluid» is meant to define a fluid being pumped by a pump device

SHORT DESCRIPTION OF THE DRAWINGS

The invention is described in detail by reference to the following drawings:

FIG. 1 is a cross-sectional view of a first exemplary pump device according to the invention, configured to provide a desired pressure increase of a pump fluid being supplied to the pump device at a pressure corresponding to the ambient pressure of the pump device.

FIGS. 2A and B are diagrams showing the pressure development at the outlet for the pump fluid, with and without the use of a stabilizing unit.

FIG. 3. is a cross-sectional view of a stabilizing unit cooperating with the pump device in FIG. 1.

DETAILED DESCRIPTION OF INVENTION

Figure 1:
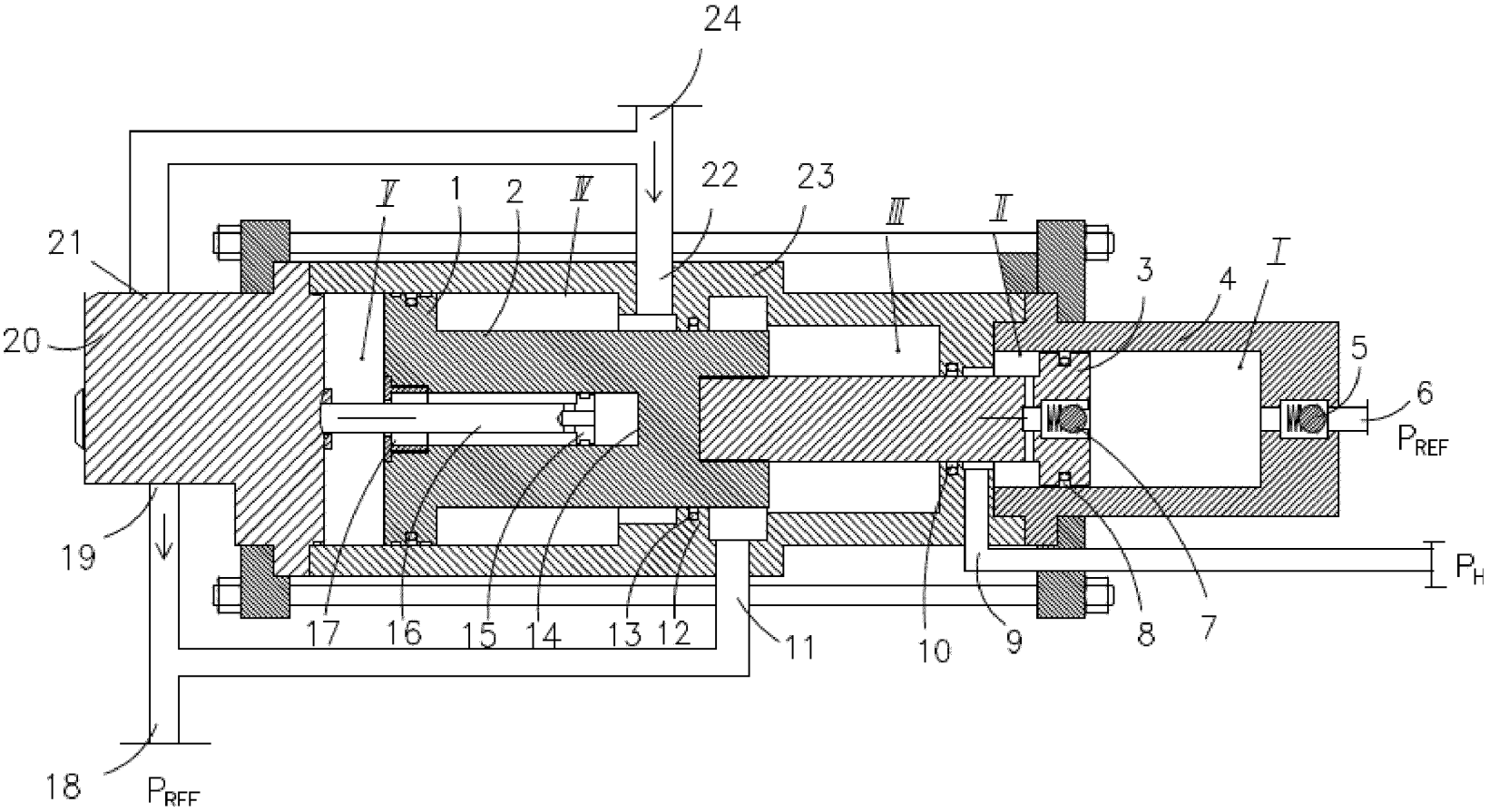

The invention concerns a double-acting pump device arranged to utilize the energy of a supplied drive fluid to provide a supplied pump fluid with a defined pressure increase, and which is based on a reciprocating piston arrangement.

The pump device is arranged to operate at high pressure levels and may in an advantageous embodiment comprise a stabilizing unit arranged to maintain a stable flow and pressure level, both on the drive side and on the pump side. Thus, the stabilizing unit minimizes the mechanical strain on both the pump device and equipment operated by the pump device.

The pump device is arranged such that the drive fluid is led from the pump device to a reservoir being approximately pressureless or which has a pressure approximately the same as the ambient pressure.

The pump device comprises a housing having a drive section and a pump section. Pressure energy from the drive fluid is transferred from the drive section to the pump section via a drive piston being a part of a piston arrangement, and which has a wide piston rod, i.e. a piston rod having a relatively large diameter, being led in a fluid-tight manner through a partition wall between the drive section and the pump section. The drive piston divides the drive section into two drive chambers, which due to the wide dimension of the piston rod have significantly different cross-sectional areas. The drive chamber having the smallest cross-section is permanently pressurized by having an open connection with the inlet of the drive fluid. It is thereby possible to force the piston arrangement to reciprocate and transfer energy to the fluid in the pump section (i.e. the pump fluid) by use of a switch mechanism which effects switching between a first operating condition, wherein the drive chamber having the largest cross-section has an open connection with the inlet and is closed off from the outlet, and a second operating condition wherein the drive chamber is closed off from the inlet and has an open connection with the outlet. The switching is guided by a cooperation between said switch mechanism and an actuating lever having a mechanical connection to the drive piston.

The starting point for the function of a pump device according to the invention has been that for a given configuration, the relationship $(P_H-P_{REF})/(P_S-P_{REF})$ shall have the same constant value (K1) independent of the sea depth (i.e. water depth). Correspondingly, a given configuration for a pump device that is to be used as a low-pressure pump, i.e. point 3 above, shall have a constant value for the relationship $K2=P_{AMB}/(P_S-P_{AMB})$. This relationship reflects that the pump device necessarily requires an increase of the drive pressure at increased depth, since the pressure of the pump fluid is to be increased from approximately zero and to the ambient water pressure.

As explained in the supporting information below, all dimensional parameters in a pump device according to the invention may be decided unequivocally from a chosen value of K1 or K2. The calculations do not take into consideration friction in seal rings etc., but this is of qualitatively little practical importance. The real value of K1 will be somewhat lower than the calculations will indicate, while K2 will be slightly higher.

In a pump device according to the invention, the piston arrangement is constructed such that a third chamber is provided in the pump section, and by adapting the relative size of the contact surfaces of the piston arrangement facing the five chambers of the pump device a desired balance between the forces affecting the piston arrangement may be achieved.

Various uses of prior art pump devices are disclosed in US 2012/0063939 A1, US 2012/4653986 A and US 2012/4548551 A. However, the present inventive pump device is not limited to the mentioned prior art uses/applications. The inventive pump device may for instance be well suited for providing a high hydraulic pressure by use of instrument air as drive fluid.

Definitions

In the description the term "the cross-section of the chamber" is used. The cross-section of the chamber A is defined as A=F/P, wherein F is the resultant of axial forces acting against the piston arrangement when the concerned chamber has the pressure P.

FIG. 1 shows a pump device which is arranged for use as a pressure booster pump. This entails that both the return pressure of the drive fluid and the supply pressure of the pump fluid is approximately equal to the ambient pressure. This embodiment is suitable for, for instance providing hydraulic pressure to operate a BOP (blow-out preventer) or for chemical injection into a subsea well.

The pump device comprises a housing 23 having a drive section and a pump section which cooperates via the piston arrangement 1-3. The piston arrangement comprises a drive piston 1 with a wide dimension piston rod 2 (i.e. the piston rod has a relatively large diameter relative the diameter of the drive piston) and a first element 3 being slidably arranged on a rigidly mounted second element 4. The piston rod 2 is guided in a fluid-tight manner through a sliding seal 13 being arranged in a partition wall 12 between the drive section and the pump section.

The drive piston 1 forms a displaceable barrier between two chambers IV,V in the drive section. The thickness of the piston rod 2 causes the drive piston 1 to have a substantially larger area facing chamber V than the area facing chamber IV. The drive piston 1 may thereby reciprocate in that chamber IV is placed in permanent open connection with the supply line 24 for the drive fluid via the inlet 22, and in that chamber V is alternately pressurized and exhausted by being connected to the drive fluid inlet 21 and to the drive fluid return line 18, respectively. The alternating pressurizing and exhausting is obtained by a switch mechanism built into the drive section end wall 20. The switch mechanism comprises a non-disclosed switch valve and a non-disclosed initiating valve which cooperates with the piston arrangement 1-3 via the actuating lever 16. When the drive piston approaches an end position contact is achieved between a protrusion 15 on the actuating lever and one of the two contact points 14,17 on the piston arrangement. After achieving contact, the actuating lever is pulled along in the further displacement of the piston arrangement. This activates the initiating valve which initiates the switching by pressurizing or exhausting, respectively, a chamber in the switch valve.

A switch mechanism having this function is described in the Norwegian patent NO340558 and in the patent application NO 2016 1801 and is considered common knowledge.

The slidable first element 3 in the piston arrangement is constructed such that it together with the two sliding seals 8,10 form three chambers in the pump section;

- a first chamber I being connected with the pump fluid inlet 6 via a first directional valve 5, which effects that chamber I is supplied with pump fluid when it expands.
- a second chamber II which is compressed and expanded in counter-phase with chamber I, and that via a second directional valve 7 is supplied with pump fluid from chamber I when chamber I is compressed.
- a third chamber III which, depending on which operation/function the pump device shall perform, has an open connection to the drive fluid return line 18 or an open connection to the pump fluid inlet 6.

The pump function works in the following manner:

- When the piston arrangement slides towards the right, chamber I is compressed, and the liquid which the chamber received at the previous expansion is pushed into chamber II via the second directional valve 7. In a preferred embodiment, the first element 3 is formed such that chamber I has a cross-section twice as large as the cross-section of chamber II. This entails that only half of the pump fluid pushed out of chamber I may be accommodated in chamber II. The remaining half is pushed out of the pump fluid outlet 9. In the disclosed embodiment it is not arranged a directional valve on the outlet 9. Therefore, chamber II will have the same pressure as the user being connected to the outlet 9.
- When the drive piston is displaced towards the left, chamber II is compressed and the pump fluid filling the chamber is pushed out of the outlet 9. Simultaneously, chamber I expands and withdraws fresh pump fluid from the inlet 6) via the first directional valve 5.

By having chamber I featuring a cross-section twice the size of the cross-section of chamber II equal amounts of pump fluid is pumped out in both stroke directions.

If both the pump fluid and the drive fluid are a liquid, one will achieve the following relationships if the pump device is dimensioned in accordance with the supporting information:

$$K1=(P_H-P_{REF})/(P_S-P_{REF})=A5/A1$$

Wherein; $P_H$=Absolute pressure of the pump fluid out, $P_S$=Absolute pressure of supplied drive fluid $P_{REF}$=Absolute pressure at the outlets 11,19)=the pressure at the pump fluid inlet 6).

A1=the cross-section of chamber I,

A5=the cross-section of chamber V.

The pump device shown in FIG. 1 is dimensioned such that A5/A1=3,5. If, for instance, $P_S$ is 100 bar above $P_{REF}$, the outlet pressure of the pump will be:

$$P_H=3{,}5*100=350 \text{ bar above } P_{REF}.$$

A pump device based on a reciprocating piston arrangement will have a drop in the fluid delivery when the piston arrangement changes stroke direction. Each switching operation causes large velocity changes both in the fluids and in moveable components of significant mass. This can generate pressure transients which in turn may entail substantially reduced life time of the pump device, as well as for equipment which the pump device is to operate. A pump device according to the invention may in an embodiment comprise a stabilizing unit (26) which, by maintaining the same level of the fluid streams while the piston arrangement changes stroke direction, will counteract deviations in the desired balance between drive pressure and pump pressure.

Figure 2A:
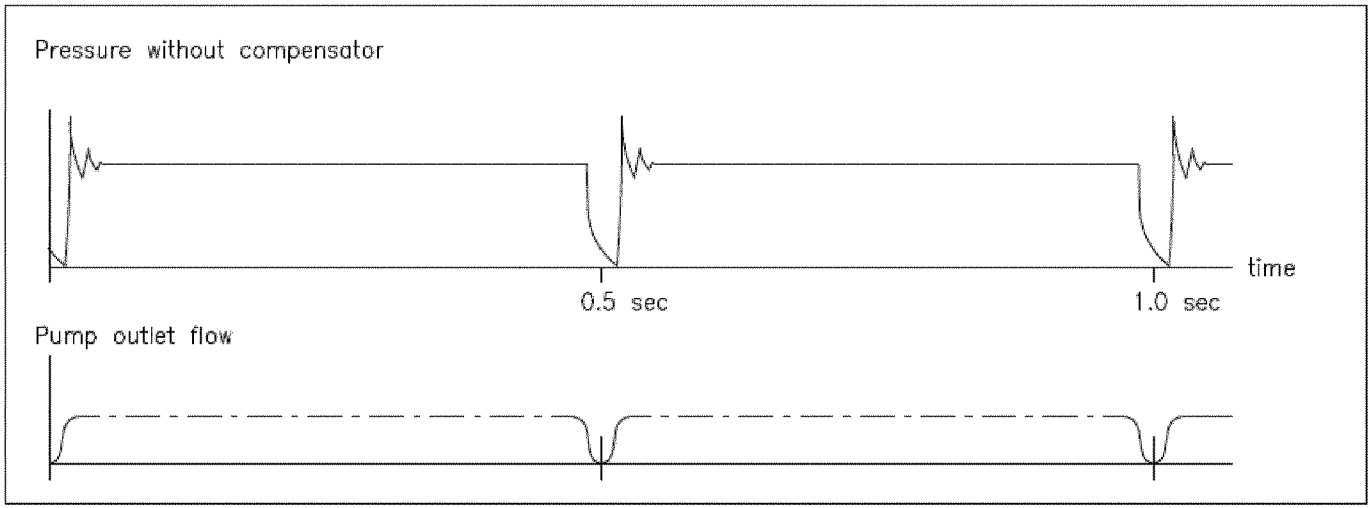

FIG. 2A indicates how pressure and flow conditions vary at the pump fluid outlet 9 if the pump device does not have such a stabilizing unit. The present pump device has in this case a pumping frequency of 1 Hz. The dotted line indicates the desired delivery level to be maintained.

Figure 2B:
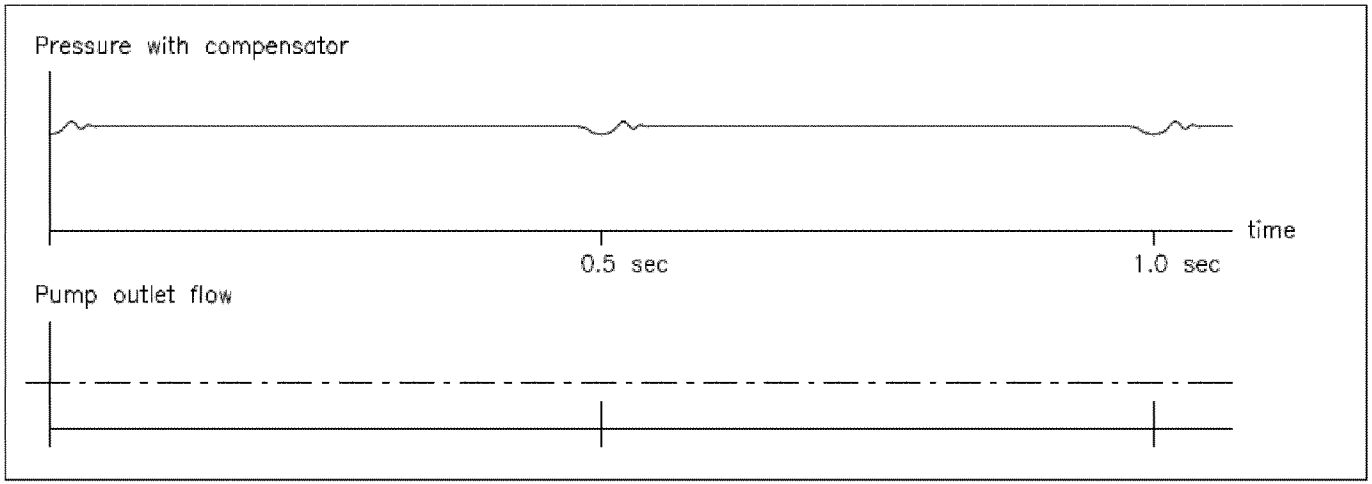

FIG. 2B indicates the corresponding pressure and flow conditions for a configuration having a pump device according to the invention and a stabilizing unit.

Figure 3:
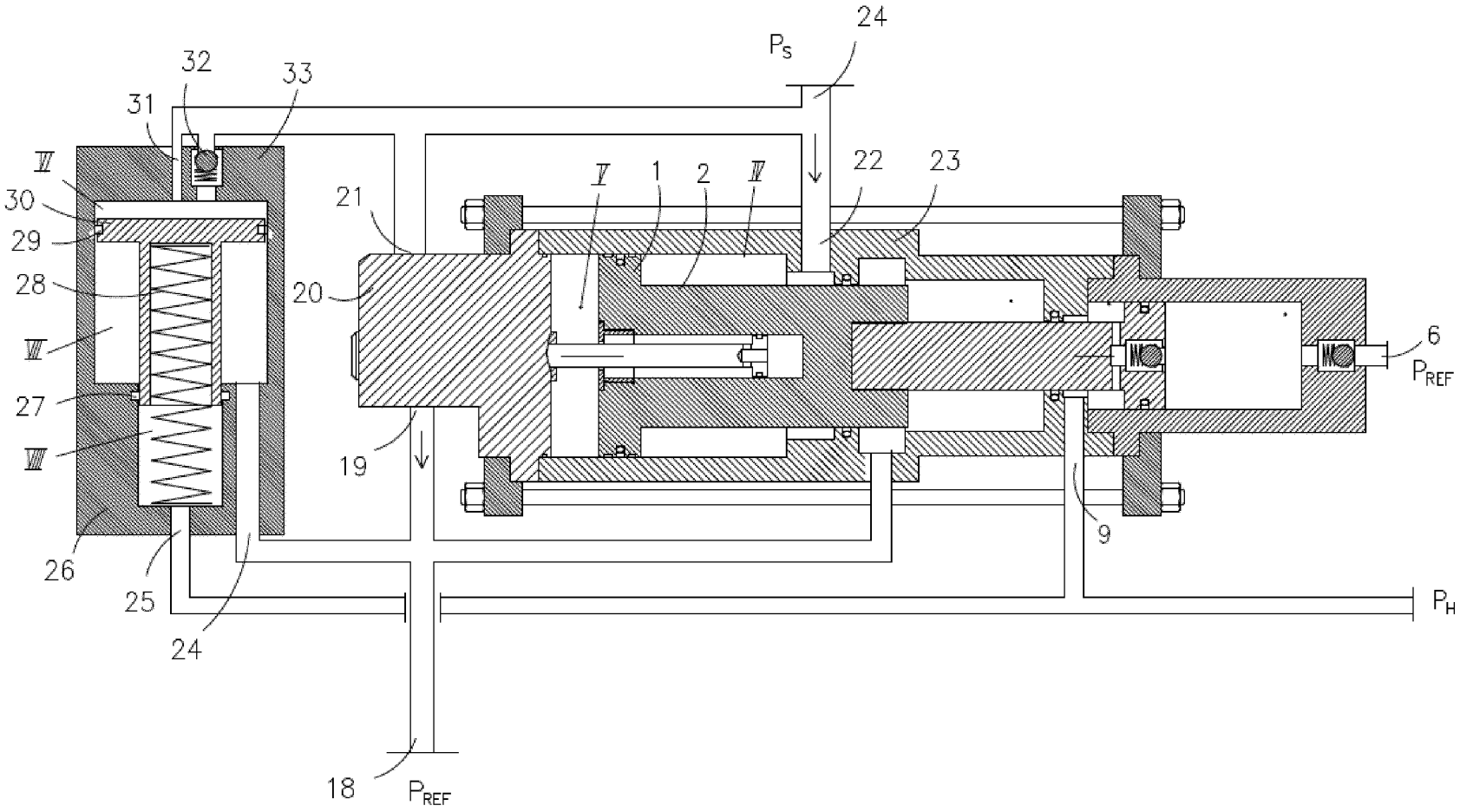

FIG. 3 shows a cross-section of the configuration providing the conditions in FIG. 2B. The stabilizing unit comprises a housing 33 and a piston 27 delimiting three chambers in the housing 33:

- chamber VI has an open connection with the drive fluid supply line 24 (and the drive fluid inlet 22) via a conduit 31,
- chamber VII has an open connection with the drive fluid return line 18 via a conduit 24,
- chamber VIII has an open connection with pump fluid outlet 9 via a conduit 25.

The stabilizing unit is arranged to compensate for reduced supply of pressurized pump fluid while the pump arrangement switches stroke direction. Therefore, chamber VIII must take up liquid from the pump device in the period between each switching operation, and exhaust liquid during the switching operation.

For chamber VIII to take up liquid in the period between each switching operation, net upwards directed force against the piston 27 must exceed the friction between the pistons and the sliding seals 27,29. In an embodiment, the stabilizing unit is dimensioned such that the pressure forces acting on the piston 30) in axial direction will be in approximately equilibrium if the pump device is in normal operation and the spring 28 is removed. From the figure we see that upwards and downwards directed forces against the piston 30) are in balance if;

$$P_H*A_H+P_{REF}(A_S-A_H)=P_S*A_S \text{ or } (P_H-P_{REF})A_H=(P_S-P_{REF})A_S$$

wherein $A_H$ is the piston area being in contact with chamber VIII and $A_S$ is the piston area being in contact with chamber VI.

Based on a pump device with K1=3,5, a desired equilibrium will be achieved by having at the piston 30 dimensioned such that $A_H/A_S$=3,5. The spring 28 may preferably be without tension when the pistons 30 upper end face is arranged adjacent to the upper inner wall in chamber VI.

The mode of operation will be explained from a relevant dimensioning of a pump device according to the invention;

A pump device according to the invention will typically be able to perform a complete switching operation in about 50 milliseconds. The pumping frequency is set to 1 Hz. The piston arrangement 1-3 has a stroke length of 100 mm, and the drive piston 1 has a diameter $A_1$=120 mm. This means that the piston arrangement in this embodiment will have a maximum velocity of 20 cm/s. During the 50 milliseconds which it takes to perform a switching operation, the piston should have moved about 10 mm. The real displacement during this operation will be about 6 mm, divided on both the stroke directions. We use a gain factor K1=3,5. This means that the pump device will have et supply deficit of pump fluid corresponding to a volume $V=A_1/3.5*4$ mm=13 $cm^3$. This means that the stabilizing unit must be able to supply 13 $cm^3$ of liquid in each single switching operation. We choose to dimension the piston 30 such that $A_H$=20 $cm^2$, which gives chamber VIII an inner diameter of about 50 mm. Consequently, the piston 27 will be displaced ca 7 mm in each switching operation.

To achieve the desired force balance, it is required that $A_S=3,5*A_H$=70 $cm^2$. It may be relevant to use a spring 28) with a spring constant of about k=10 kp/mm. In that case, the spring tension will be reduced by 70 kp while the pump fluid is provided from the stabilizing unit, corresponding to having the supply pressure lowered by 3.5 bar. One must expect a certain adhesion from the sealing rings 27) of the pistons, such that the pressure at the stabilizing unit outlet 25 falls 1-2 bar before this friction is overcome. The piston 30 may thus easily enter into smaller oscillations. To counteract this, the conduit 31 is relatively narrow, and a one-way vale 32 is arranged in parallel with the conduit. The one-way valve will allow fast supply of drive fluid to the chamber VI, such that the piston 27 will have a fast downwards directed displacement when it is to compensate for the drop in the supply of pump fluid. It becomes more time consuming to push the piston upwards since the fluid then must be pushed out of chamber VI via the conduit 31.

At each switching operation, the stabilizing unit must compensate for lack of supply from the pump device by supplying about 13 $cm^3$ of pump fluid in 50 milliseconds. In a new filling of chamber VII, one has about 450 milliseconds at disposal. The conduit 31 may thus be relatively narrow without the occurrence of problems with the supply capacity.

Figure 4:
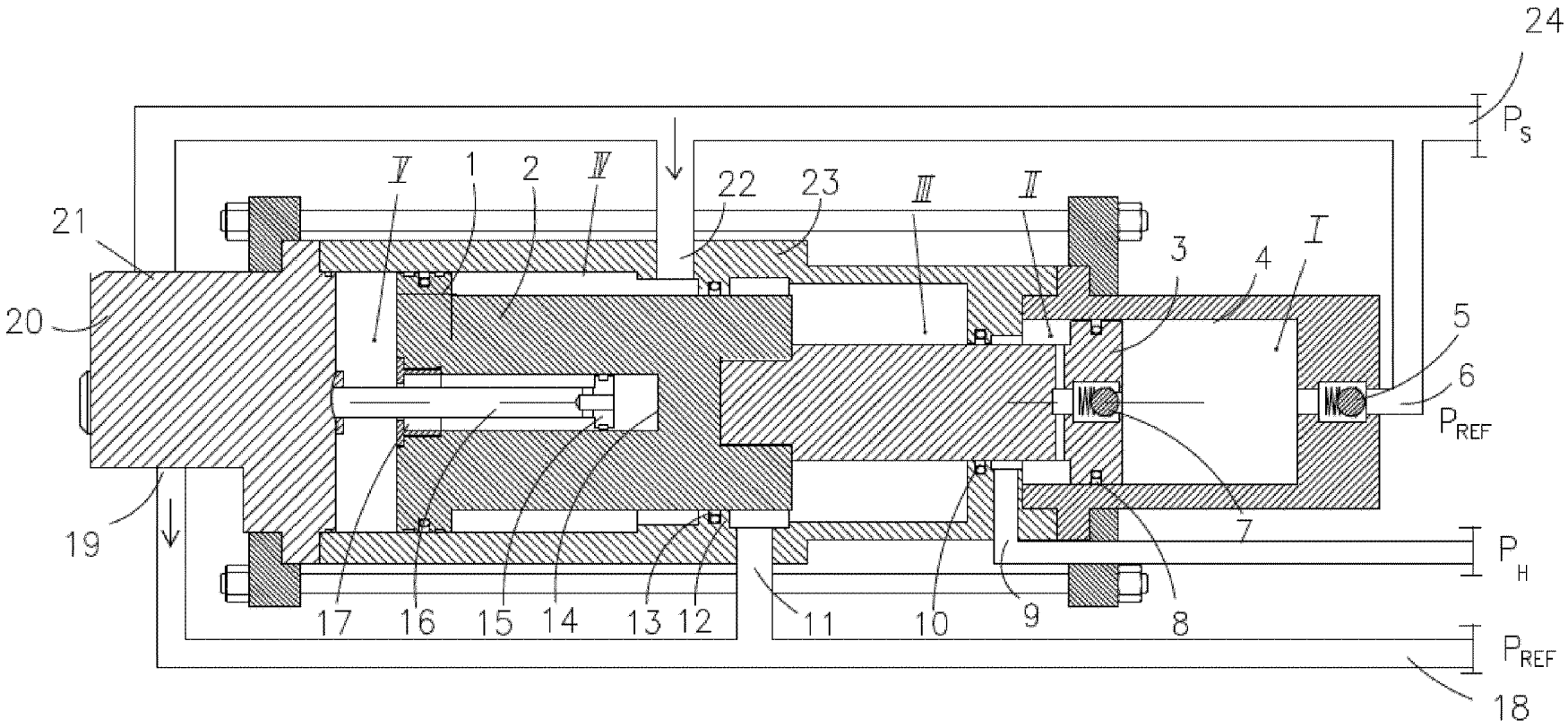
FIG. 4 is a cross-sectional view of a second exemplary embodiment of a pump device according to the invention, configured to be used as an intensifier.

FIG. 4 shows an embodiment wherein a pump device according to the invention is configured to be used as an intensifier. This embodiment is substantially equal to the embodiment in FIG. 1, but to achieve the desired relationship between the drive pressure ($P_S-P_{REF}$) and the pump fluid supply pressure ($P_H-P_{REF}$) it is necessary to change the size ratios of the internal chambers in the pump device. The supporting information below shows calculations related to an intensifier pump device. The following relationships are obtained:

$$K1=(P_H-P_{REF})/(P_S-P_{REF})=(A_5/A_1+1)$$

Wherein: $P_H$=Absolute pressure on the pump fluid out,
$P_S$=Absolute pressure on supplied drive fluid
$P_{REF}$=Absolute pressure at the outlets 15,20
$A_5$=the cross-section of Chamber V
$A_1$=the cross-section of chamber I In these calculations it is provided that chamber I has two times the cross-section as chamber II, e.g. that $A_3=2*A_4$, such that equal amounts of pump fluid is provided in each of the stroke directions.

In the supporting information it is shown that the requirement for achieving the desired relationship between drive pressure and supply pressure is that the piston arrangement is dimensioned such that:

$$A_1=A_5/(K1-1),\ A_4=A_5*0.5*(K1-2)/(K1-1)$$

At a chosen value for K1, mutual dimensioning of the pump device components will be unequivocally decided. FIG. 4 shows a view of an intensifier being dimensioned for the same K1 factor as the pressure booster pump shown in FIG. 1, e.g. K1=3.5.

Figure 5A:
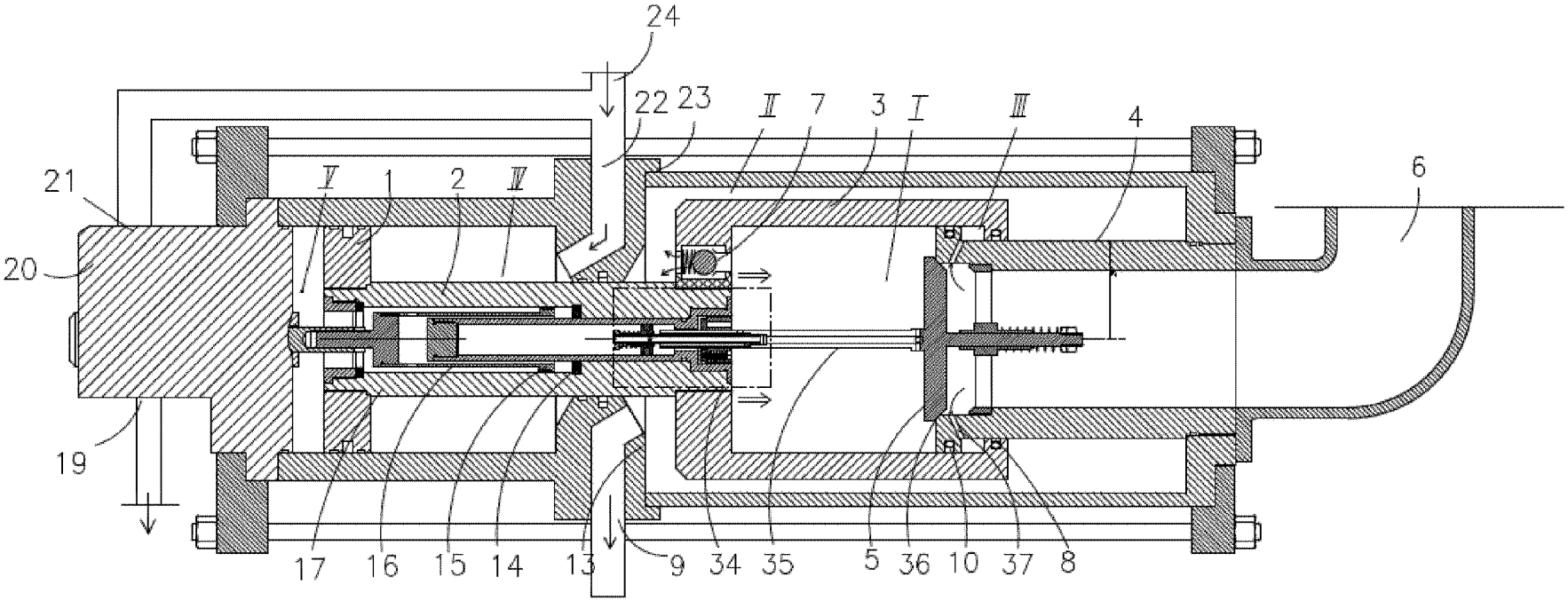
FIG. 5A and FIG. 5B are cross-sectional views of a third exemplary embodiment of a pump device according to the invention, configured to pump liquid out of an approximately pressureless tank
Figure 5B:
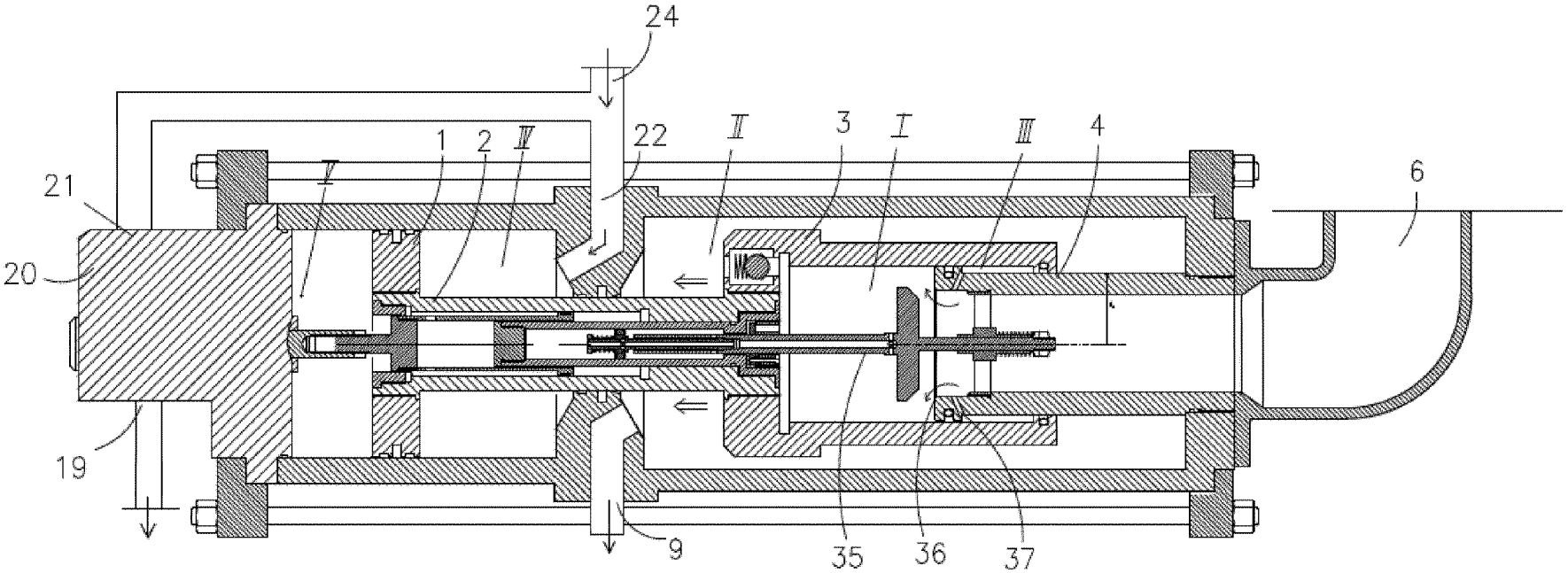

FIGS. 5A and 5B show a view of two pump devices arranged to pump liquid out of an approximately pressure-less tank and out to the surrounding sea, or to a reservoir being pressure-equalized with the surrounding sea. The pump devices in FIGS. 5A and 5B are configured for K2 values of 1 and 2, respectively.

The mode of operation is described by reference to the embodiment in FIG. 5A. A first element 3 is shaped as a sleeve and is slidably arranged on an external guide on the rigidly mounted second element 4). The piston arrangement 1-3 delimits three chambers in the pump section;

- a first chamber I having a cross-section $A_1$ being defined by the inner diameter of the chamber.
- a second chamber II having a cross-section $A_2$ and being delimited by the inner walls in the drive section, the external surface of the first and the second element, as well as the surface of the part of the piston rod 2 arranged within the drive section. In this case, $A_2=\pi*(R_4^2-R_2^2)$, wherein $R_2$ is the diameter of the piston rod 2 and $R_4$ is the radius of the guide on the external surface of the second element 4.
- a third chamber III having a cross-section $A_3$, and being delimited by the volume obtained between the two sliding seals 8,10. Chamber III has an open connection with the inlet 6.

The pump function works as follows:

When the piston arrangement 1-3 is displaced towards the left, the mechanism within the dotted frame 34 ensures that it is performed, via the actuating lever 32), a leftwards directed pull which pulls the valve body 5 off the seat 36 in the second element 4, and thereby allows the pump fluid to flow into chamber I via the internal conduit in the second element 4. Simultaneously, the displacement causes a compression of chamber II, such that the pump fluid filling this chamber is pushed out of the outlet 9). The outlet 9) may be connected to a non-disclosed reservoir being pressure-equalized with the surroundings—or which is open towards the surroundings. The mechanism 34 effects that the pull in the actuating lever 32 is stopped just before the piston arrangement has arrived at the end point, and a rightwards directed spring tension effects that the valve 5) is quickly pushed back onto the seat 33.

When the piston arrangement is displaced towards the right, chamber I is compressed and the pump fluid which this chamber received in the previous expansion is pushed out through the second directional valve 7. Chamber II is compressed and expanded in counter-phase with chamber I, and since we choose to let the effective cross-section of chamber II be half the size of the cross-section of chamber I, half of the pushed-out volume is received by chamber II. The remaining half is pushed out of the outlet 9. In this manner, an equal amount of pump fluid will be provided in both stroke directions.

In Norwegian patent NO340558 a purely mechanical tilt mechanism is used to control the open/close function of a directional valve which have substantially the same function as in the present invention. The tilt mechanism effects an approximately instantaneous switching between open and closed condition when the piston arrangement approaches an end stop. We consider alternative solutions for control of the first directional valve to be well-known prior art.

I this embodiment, two oppositely directed surfaces of the first element 3) is affected by the pressure in chamber II.

From FIG. 5 we see that. $A_5-A_4=\pi*R_2^2$, and $A_1=\pi*R_4^2+A_3$ wherein $R_2$ is the diameter of the piston rod 2), $R_4$ is the radius of the external guide on the second element 4 and A3 is the cross-section of chamber III.

Thus: $A_2=\pi*(R_4^2-R_2^2)=(A_1-A_3)-(A_4-A_5)=A_1-A_3-A_4+A_5=A_1/2$

The value for $A_2$ is used in the calculations in the supporting information.

These calculations show that $K2=P_{AMB}(P_S-P_{AMB})=A_5/A_1$ The K2-value should be chosen based on how large a drive pressure is available and on how large a sea depth the pump device shall be used on.

The drive fluid may be a non-lubricating fluid, something which with current technology may typically limit available drive pressure to 170 bar. This means that with K2=1, the pump device will have a maximum operational depth of about 1700 meter.

A chosen value for K2 entails an unequivocally defined mutual dimensioning of five chambers of the pump device.

FIG. 5A shows a view of an embodiment with K2=1. FIG. 5B shows a corresponding view with K2=2, which may be a suitable value if the pump device is to be used at sea depths of 3000 meters.

When a pump device according to the invention is configured as a low-pressure pump, the outlet pressure will commonly be equal to the ambient pressure, and there is consequently no need for any stabilization of the supply pressure of the pump fluid.

Supporting Information

The following calculations are based on the embodiments in FIGS. 1, 4 and 5, which show the present invention configured for the different operations discussed above.

To illustrate that the different embodiments have the desired properties, calculations based on equilibrium evaluations have been performed. This entails that one looks at both stroke directions and requires balance between axial forces which are provided on the pressure surfaces of the piston arrangement during the relevant conditions.

Section 1—Pressure Booster Pump

Embodiment of a pump device which increase the pressure in a pump fluid which is supplied at the same pressure as the reference pressure of the drive unit=$P_{REF}$ Ref FIG. 1

Definitions $P_S$=the supply pressure of the drive fluid $P_{REF}$=the return pressure of the drive fluid=the supply pressure of the pump fluid $P_H$=The supply pressure of the pump Effective area (cross-section) in the chambers I-V is denoted $A_1-A_5$ Prerequisite: $A_2=A_1/2$ From FIG. 1: $A_3=(A_5-A_4)-(A_1-A_2)=A_5-A_4-A_1/2$ Rightwards Directed Piston Movement Rightwards directed force provided by the pressure in chamber $V=P_S*A_5$ Rightwards directed force provided by the pressure in chamber $II=P_H*A_1/2$ Leftwards directed force provided by the pressure in chamber $IV=P_S*A_4$ Leftwards directed force provided by the pressure in chamber $I=P_H*A_1$ Leftwards directed force provided by the pressure in chamber $III=P_{REF}*(A_5-A_4-A_1/2)$ Force balance requires $P_S*A_5+P_H*A_1/2=P_S*A_4+P_H*A_1+P_{REF}*(A_5-A_4-A_1/2)$ Thus 1) $P_S*(A_5-A_4)-P_H*A_1/2=P_{REF}*(A_5-A_4-A_1/2)$ Leftwards Directed Piston Movement.

Rightwards directed force provided by the pressure in chamber $V=P_{REF}*A_5$

Rightwards directed force provided by the pressure in chamber $II=P_H*A_1/2$

Leftwards directed force provided by the pressure in chamber $IV=P_S*A_4$

Leftwards directed force provided by the pressure in chamber $I=P_{REF}*A_1$

Leftwards directed force provided by the pressure in chamber $III=P_{REF}*(A_5-A_4-A_1/2)$ Force balance requires $P_{REF}*A_5+P_H*A_1/2=P_S*A_4+P_{REF}*A_1+P_{REF}*(A_5-A_4-A_1/2)$ Thus 2) $P_S*A_4-P_H*A_1/2=P_{REF}*(A_4-A_1/2)$ The equations 1) and 2) are equal if $A_5=2*A_4$ When this is introduced we find $K1=P_H-P_{REF})/(P_S-P_{REF})=A_5/A_1$ Consequently, at a chosen value for K1, a mutual dimensioning of the pump components may be unequivocally decided.

Section 2. Intensifier

An embodiment of a pump device which increases the pressure of a pump fluid which is supplied to the pump at the same pressure as the supply pressure of the drive unit=$P_S$ Ref. FIG. 4

Definitions $P_S$=the supply pressure for the drive fluid=the supply pressure of the pump fluid $P_{REF}$=the return pressure of the drive fluid $P_H$=The supply pressure of the pump Effective area (cross-section) in the chambers I-V is denoted $A_1-A_5$ Prerequisite; $A_2=A_1/2$ From FIG. 4: $A_3=(A_5-A_4)-(A_1-A_2)=A_5-A_4-A_1/2$ Rightwards Directed Piston Movement Rightwards directed force provided by the pressure in chamber $V=P_S*A_5$ Rightwards directed force provided by the pressure in chamber $II=P_H*A_2=P_H*A_1/2$ Leftwards directed force provided by the pressure in chamber $IV=P_S*A_4$ Leftwards directed force provided by the pressure in chamber $I=P_H*A_1$ Leftwards directed force provided by the pressure in chamber $III=P_{REF}*(A_5-A_4-A_1/2)$ Force balance requires $P_S*A_5+P_H*A_1/2=P_S*A_4+P_H*A_1+P_{REF}*(A_5-A_4-A_1/2)$ Thus $P_S*(A_5-A_4)-P_H*A_1/2=P_{REF}*(A_5-A_4-A_1/2)$ Or 1) $K1=(P_H-P_{REF})/(P_S-P_{REF})=2*(A_5-A_4)/A_1$ Leftwards Directed Piston Movement.

Rightwards directed force provided by the pressure in chamber $V=P_{REF}*A_5$

Rightwards directed force provided by the pressure in chamber $II=P_H*A_2=P_H*A_1/2$ Leftwards directed force provided by the pressure in chamber $IV=P_S*A_4$ Leftwards directed force provided by the pressure in chamber $I=P_S*A_1$ Leftwards directed force provided by the pressure in chamber III=$P_{REF}*(A_5-A_4-A_1/2)$ Force balance requires $P_{REF}*A_5+P_H*A_1/2=P_S*A_4+P_S*A_1+P_{REF}*(A_5-A_4-A_1/2$ Thus $P_S*(A_4+A_1)-P_H*A_1/2=P_{REF}*(A_4+A_1/2)=P_{REF}*(A_4+A_1-A_1/2)$ or 2) $K1=(P_H-P_{REF})/(P_S-P_{REF})=2*(A_4+A_1)/A_1$ We see that the equations 1) and 2) are equal if we require: $A_5-A_4=A_4+A_1$ This provides $A_4=(A_5/2-A_1/2)$ which then is introduced into equation 2);

Thus is obtained: $A_1=A_5/(K1-1)$ or $K1=(A_5/A_1+1)$

Further is obtained: $A_4=(A_5/2-A_1/2)=A_5*0.5*(K1-2)/(K1-1)$

Consequently, at a chosen value for K1, a mutual dimensioning of the pump components may be unequivocally decided.

Section 3. Low-Pressure Pump

An embodiment of a pump device arranged to remove liquid from a tank being approximately pressureless, and pump the liquid to the surroundings or to a reservoir being pressure-equalized with the surroundings.

Ref FIGS. 5A and 5B

Definitions $P_S$=the supply pressure of the drive fluid $P_{AMB}$=ambient pressure=The supply pressure of the pump Effective area (cross-section) in the chambers I-V is denoted $A_1-A_5$ Tank pressure=0

From the specification above we have: $A_2=A_1/2=A_1-A_3-A_4+A_5$

From FIG. 5 we see. $A_3=(A_5-A_4)-(A_1-A_2)=A_5-A_4+A_1/2$

Rightwards Directed Piston Movement.

Rightwards directed force from chamber V=$P_S*A_5$

Rightwards directed force from chamber II=$A_2*P_{AMB}=(A_1-A_3-A_5+A_4)*P_{AMB}$ Rightwards directed force from chamber III=0

Leftwards directed force from chamber IV=$P_S*A_4$

Leftwards directed force from chamber I=$P_{AMB}*A_1$

Force balance requires $P_S*A_5+P_{AMB}*(A_1-A_3-A_5+A_4)=P_S*A_4+P_{AMB}*A_1$ or 1) $P_S*(A_5-A_4)=P_{AMB}*(A_3+A_5-A_4)$ Leftwards Directed Piston Movement.

Rightwards directed force from chamber V=$P_{AMB}*A_5$

Rightwards directed force from chamber II=$A_2*P_{AMB}=(A_1-A_3)-(A_5-A_4))*P_{AMB}$ Rightwards directed force from chamber III=0

Leftwards directed force from chamber IV=$P_S*A_4$

Leftwards directed force from chamber I=0

Force balance requires $P_S*A_4=P_{AMB}*A_5+P_{AMB}(A_1-A_3-A_5+A_4)$ or 2) $P_S*A_4=P_{AMB}*(A_1-A_3+A_4)$ From equation 1): $P_{AMB}/(P_S-P_{AMB})=K2=(A_5-A_4)/A_3$ thus $A_4=A_5-K2*A_3$ From equation 2): $P_{AMB}/(P_S-P_{AMB})=K2=A_4/(A_1-A_3)$ By adding the equations 1) and 2) we find: $P_S*A_5=P_{AMB}*(A_5+A_1)$ or $P_{AMB}/(P_S-P_{AMB})=A_5/A_1=K2$ We require: $A_2=A_1/2$, eg. $(A_1-A_3-A_5+A_4)=A_1/2$ Thus, we have the required information to find the relationship between the cross-section of the respective chambers in relation to A5 when a value of the factor K2 has been chosen.

We find:

$A1=A5/K2$, $A2=A_5/2*K2$, $A3=A5/(2K2*(1+K2))$, $A4=A5(2*K2+1)/(2*K2+2)$

Chooses K2=2 and finds $A_1=A_5/2$, $A_2=A_5/4$, $A_3=A_5/4$, $A_4=A_5*3/4$

Chooses K2=1 and finds $A_1=A_5$, $A_2=A_5/2$, $A_3=A_5/4$, $A_4=A_5*5/6$

The invention claimed is:

1. A double-acting pump device comprising: a piston arrangement being slidably arranged in a pump housing, the pump housing being separated into a drive section with a drive fluid inlet and a drive fluid outlet and a pump section with an inlet and an outlet for a pump fluid, and wherein the drive section comprises a switch mechanism which utilizes the difference between the drive fluid supply pressure and the drive fluid outlet pressure to reciprocate the piston arrangement, such that axially acting forces are transferred to the pump fluid which thereby achieves a desired pressure increase, wherein the piston arrangement comprises a drive piston being displaceable in a cylindrical guide in the drive section and having a piston rod being slidably arranged through a partition wall in a fluid-tight manner between the drive section and the pump section, such that the drive section is separated into two drive chambers (IV,V) having different cross-sections, and wherein the drive chamber (IV) with the smallest cross-section is permanently open towards the drive fluid inlet, wherein the switch mechanism comprises a switch valve and an initiating valve cooperating with the drive piston via an actuating lever which is subjected to an alternating pull and push each time the drive piston approaches an end point, whereby the initiating valve switches between pressurizing and exhausting a chamber in the switch valve and thereby provide a switch between a first operating condition, wherein the drive chamber (V) having the largest cross-section has an open connection with the inlet and is closed from the outlet, and a second operating condition, wherein the drive chamber (V) is closed off from the inlet and has an open connection with the outlet, the piston arrangement further comprises a displaceable first element being connected to the piston rod on the inside of the pump section and displaceable in relation to a rigidly mounted second element, and the first element cooperates with to sliding seals such that a first (I), a second (II) and a third chamber in the pump section are separated by fluid-tight barriers, wherein the first chamber (I)) is connected with the pump fluid inlet via at least one directional valve, the directional valve being closed when the first chamber is compressed and opens for supply of liquid from the pump fluid inlet when the first chamber (I) is expanded, the second chamber (II) has a smaller cross-section than the first chamber and is compressed and expanded in counter-phase with the first chamber (I), the second chamber (II) is connected to the first chamber (I) via at least one directional valve which opens when the first chamber (I) is compressed, whereby a part of the liquid provided from chamber (I) is taken up into the second chamber (II) and the remaining part of the liquid is let out via a pump fluid outlet, and which closes when the first chamber (I) is expanded whereby the liquid in the second chamber (II) is let out via the pump fluid outlet, the third chamber (III) is a pressure compensation chamber having an open connection with the drive fluid outlet or with the pump fluid inlet depending on the function which the pump device is configured for.

2. The double-acting pump device according to claim 1 further comprising: a cooperating stabilizing unit, the stabilizing unit comprising a housing having a slidably arranged piston being acted upon in axial direction by the tension of a spring, and the piston separates the housing into three chambers (VI,VII,VIII), wherein a first chamber (VI) is in permanent and open connection with the drive fluid inlet via a drive fluid supply line, a second chamber (VII) is in an open connection with the drive fluid outlet and a third chamber (VIII) has an open connection with the pump fluid outlet, wherein the piston and the spring are dimensioned such that an equilibrium between the forces acting on the piston in an axial direction is obtained during operation, and such that the equilibrium is maintained by having the piston displaceable such that liquid is taken up into or let out from the chambers (VI,VII,VIII).

3. The double-acting pump device according to claim 1 being dimensioned such that the first chamber (I) in the pump section has a change in volume being twice as large as the change in volume of the second chamber (II) in the pump section when the piston arrangement is displaced.

4. The double-acting pump device according to claim 2 being dimensioned such that the first chamber (I) in the pump section has a change in volume being twice as large as the change in volume of the second chamber (II) in the pump section when the piston arrangement is displaced.

* * * * *